US011426840B2

(12) United States Patent
Su

(10) Patent No.: US 11,426,840 B2
(45) Date of Patent: Aug. 30, 2022

(54) WRENCH CAPABLE OF APPLYING DRIVING FORCE ON OBJECT TO BE DRIVEN EFFECTIVELY

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 11 days.

(21) Appl. No.: 16/995,982

(22) Filed: Aug. 18, 2020

(65) Prior Publication Data

US 2021/0178556 A1 Jun. 17, 2021

(30) Foreign Application Priority Data

Dec. 12, 2019 (TW) ..... 108145493

(51) Int. Cl.
*B25B 13/00* (2006.01)
*B25B 13/46* (2006.01)

(52) U.S. Cl.
CPC ..... *B25B 13/462* (2013.01)

(58) Field of Classification Search
CPC ..... B25B 13/462; B25B 13/08; B25B 13/146
USPC ..... 81/52, 99, 111, 186
See application file for complete search history.

(56) References Cited

U.S. PATENT DOCUMENTS

| | | | | |
|---|---|---|---|---|
| 1,505,652 | A * | 8/1924 | McCord | B25B 13/505 81/99 |
| 1,627,035 | A * | 5/1927 | Jahn | B25B 13/28 81/99 |
| 3,309,949 | A * | 3/1967 | Neff | B25B 13/46 81/111 |
| 4,222,293 | A | 9/1980 | Schreyer et al. | |
| 5,832,795 | A | 11/1998 | Reynolds | |
| 5,894,768 | A * | 4/1999 | Malkin | B25B 13/12 81/165 |
| 2006/0201283 | A1* | 9/2006 | Petkovic | B25B 13/28 81/99 |

FOREIGN PATENT DOCUMENTS

| | | | |
|---|---|---|---|
| CN | 2595526 | Y | 12/2003 |
| CN | 101347929 | A | 1/2009 |
| CN | 207901011 | U | 9/2018 |
| TW | M575751 | U | 3/2019 |

* cited by examiner

*Primary Examiner* — Joseph J Hail
*Assistant Examiner* — Shantese L McDonald
(74) *Attorney, Agent, or Firm* — Alan D. Kamrath; Karin L. Williams; Mayer & Williams PC

(57) ABSTRACT

A wrench has a driving head segment defining a portion of a receiving space of the wrench and including a first driving side of the wrench. The driving side includes a plurality of driving sections for abutting against the object. The plurality of driving sections includes surfaces aligned along an axis. The driving side includes a plurality of first recesses disposed alternatively among the plurality of first driving sections.

19 Claims, 8 Drawing Sheets

WRENCH CAPABLE OF APPLYING DRIVING FORCE ON OBJECT TO BE DRIVEN EFFECTIVELY

BACKGROUND OF THE INVENTION

1. Field of the Invention

The present invention relates to a wrench and, particularly, to a wrench capable of applying driving force on an object to be driven effectively.

2. Description of the Related Art

TW Pat. No. M575751 discloses an adjustable wrench including a first jaw pivoted to an end of a handle and defining a groove and a second jaw movably disposed on the groove. The adjustable wrench holds an object to be driven between the first and the second jaws. Particularly, the first and the second jaws each include convex portions abutting against corners of the object. Further, the second jaw has a notch and the end of the handle has a pivoting member including a protrusion selectively abutting against first and second side walls of the notch. Particularly, when the protrusion abuts against a first side wall of the notch, the second jaw will move towards the direction of the first jaw; and when the protrusion abuts against a second side wall of the notch, the second jaw will move away from the first jaw.

The adjustable wrench, however, has a problem of grasping an object in which corners are damaged or rounded.

The present invention is, therefore, intended to obviate or at least alleviate the problems encountered in the prior art.

SUMMARY OF THE INVENTION

According to the present invention, a wrench capable of applying driving force on an object to be driven effectively has a driving head segment defining a portion of a receiving space of the wrench and including a first driving side of the wrench. The driving side includes a plurality of driving sections for abutting against the object. The plurality of driving sections includes surfaces aligned along an axis. The driving side includes a plurality of first recesses disposed alternatively among the plurality of first driving sections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
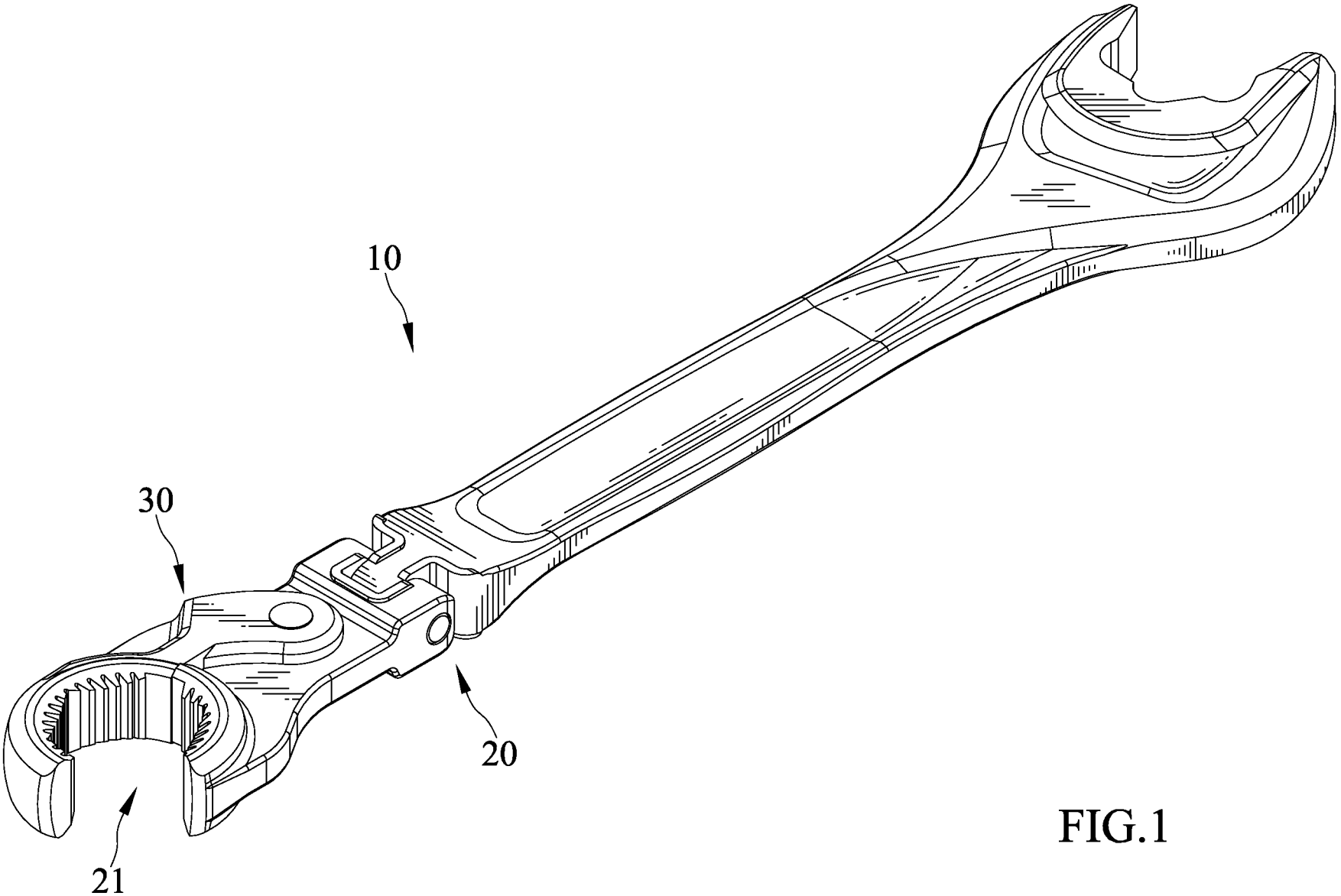
FIG. 1 is a perspective view of a wrench in accordance with the present invention capable of applying driving force on an object to be driven effectively.
Figure 2:
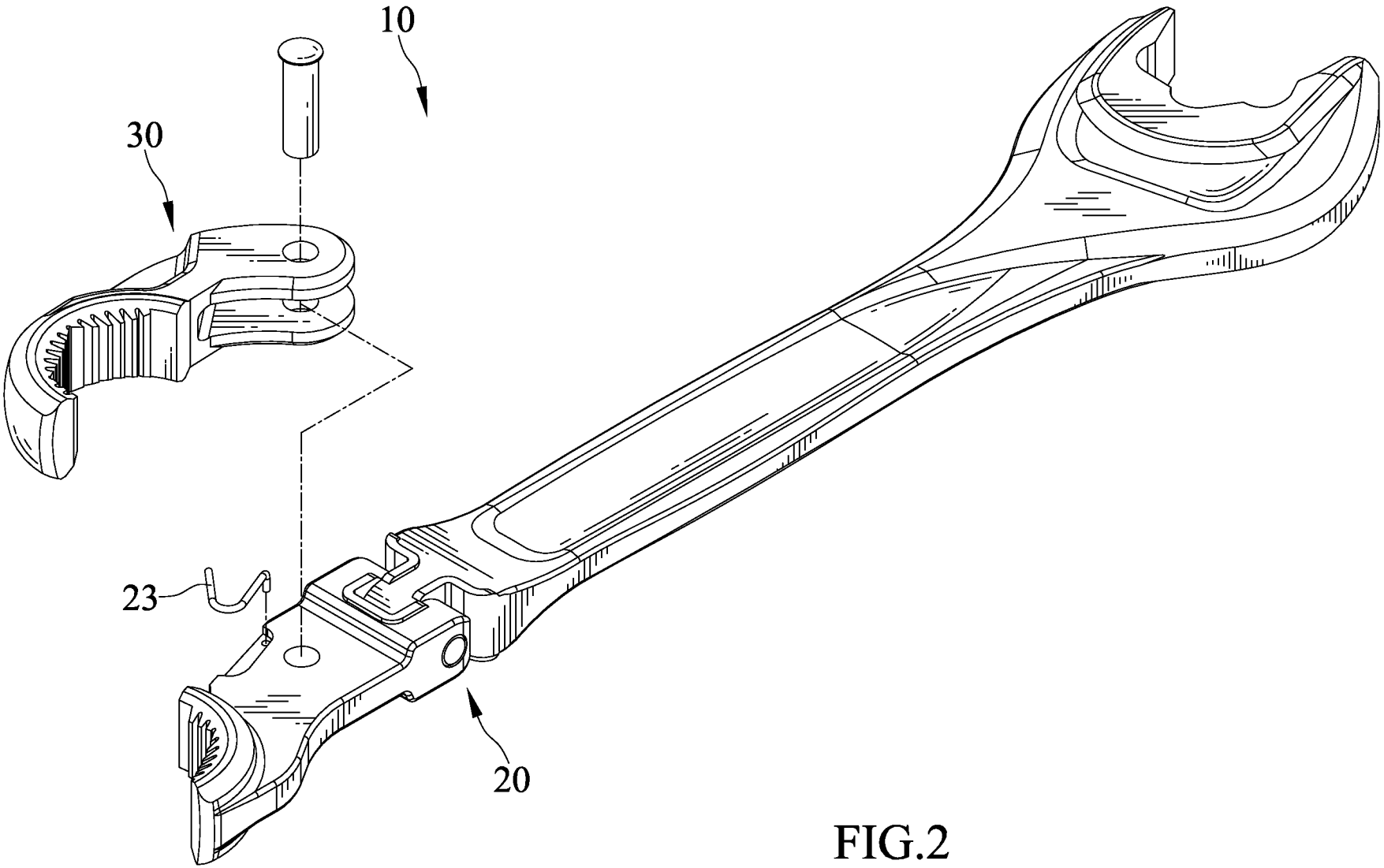
FIG. 2 is an exploded perspective view of FIG. 1.
Figure 3:
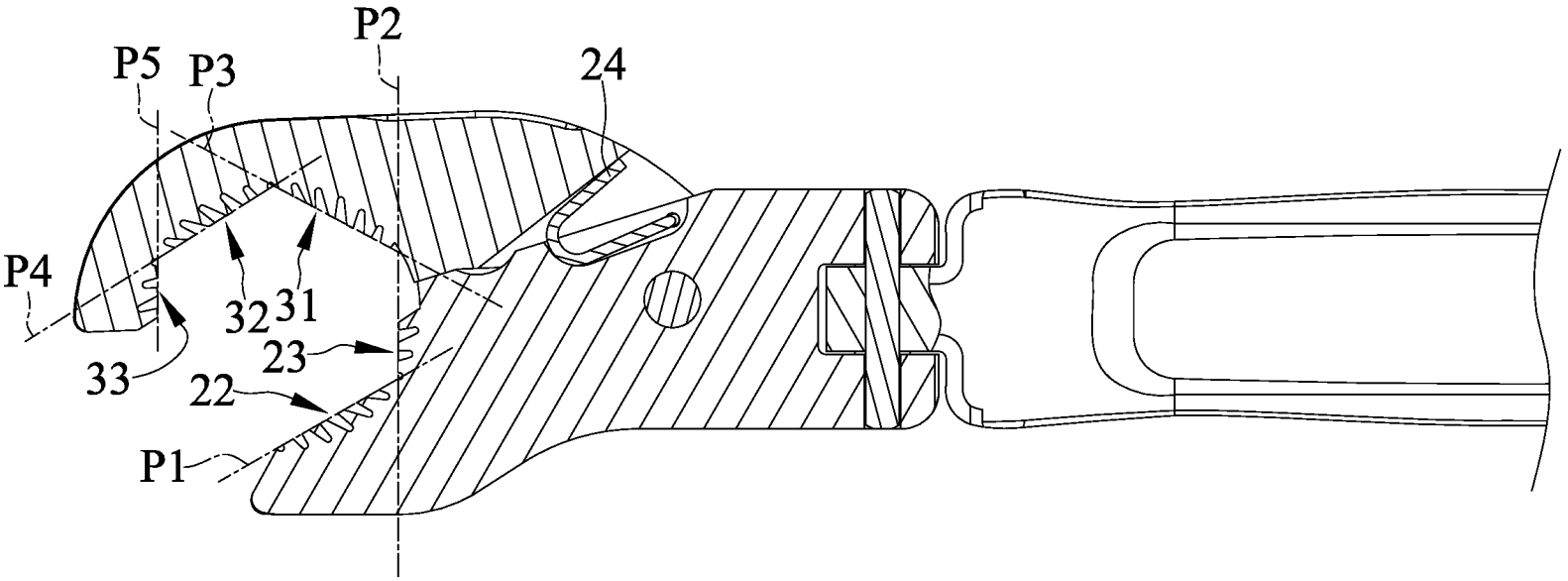
FIG. 3 is a partial, cross-sectional view of FIG. 1.
Figure 4:
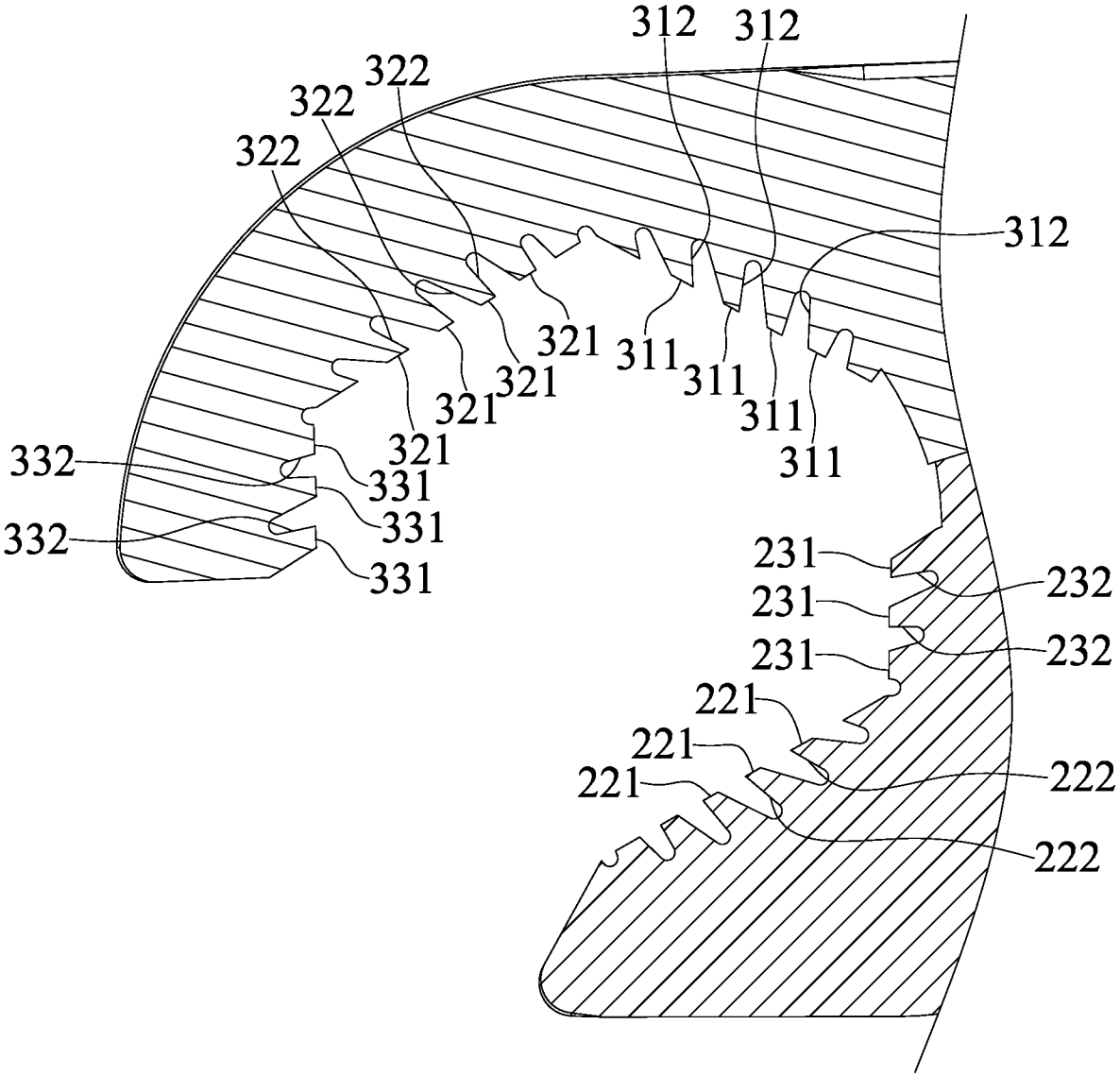
FIG. 4 is an enlarged view of FIG. 3.
Figure 5:
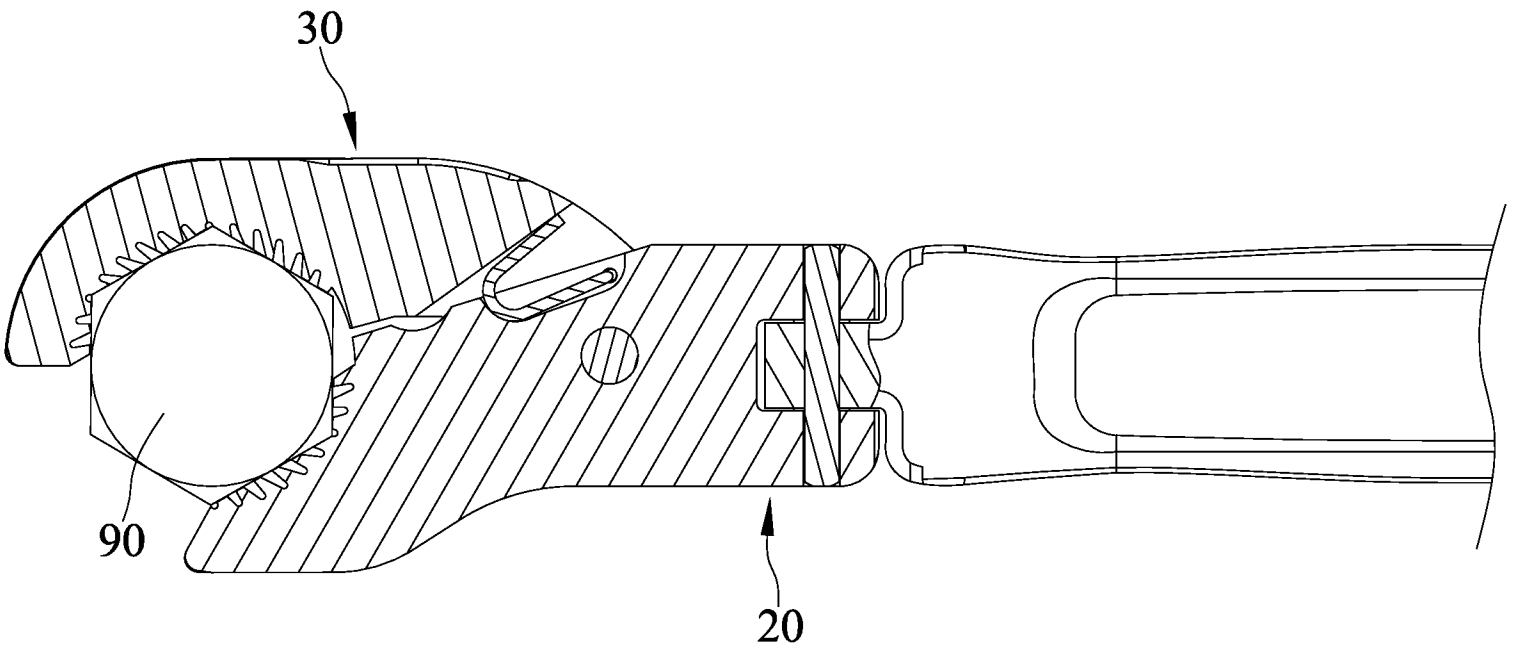
FIG. 5 illustrates the wrench of FIG. 1 grasping an object.
Figure 6:
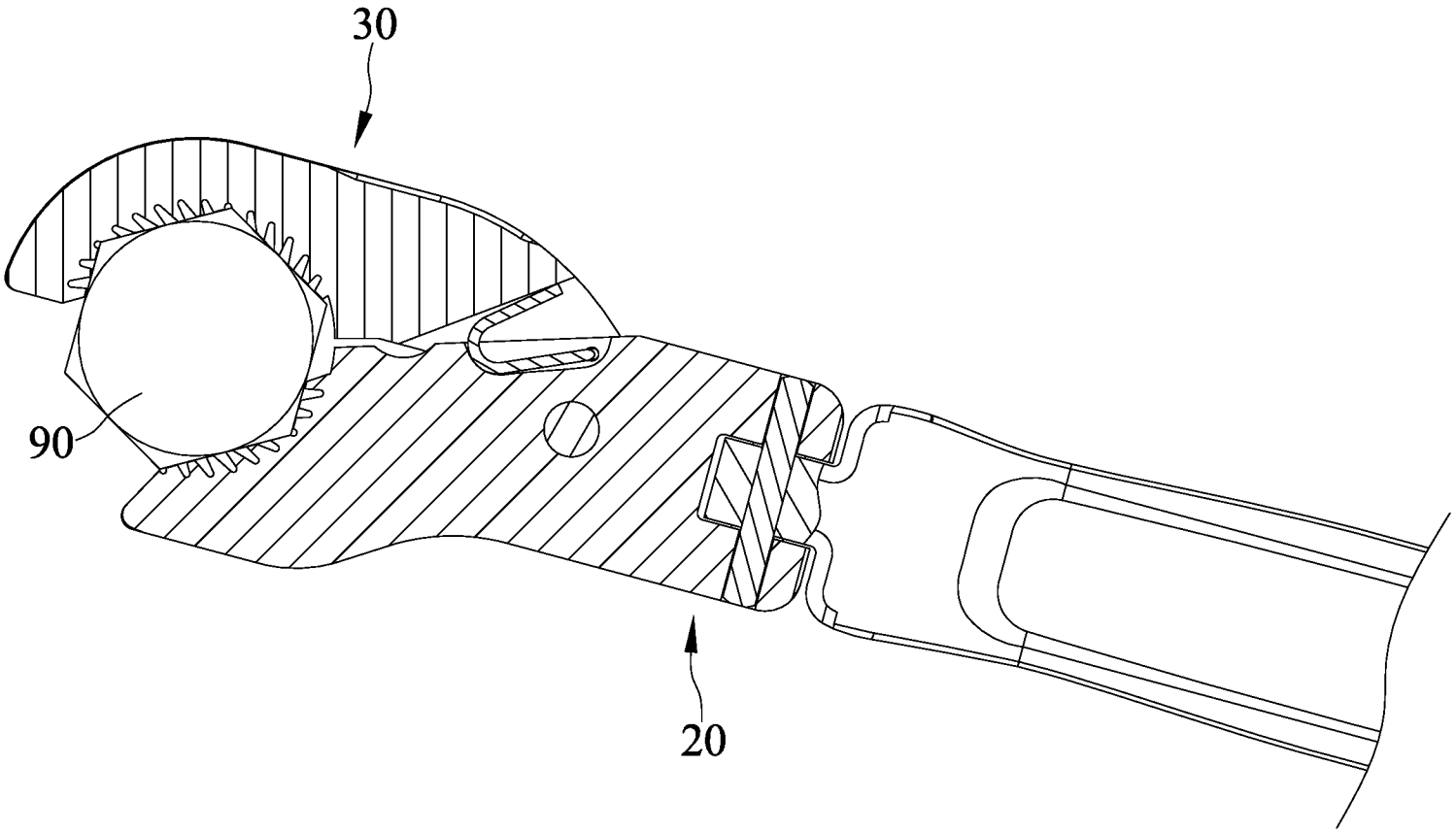
FIG. 6 illustrates the wrench of FIG. 1 driving the object to a position different from that of FIG. 5.
Figure 7:
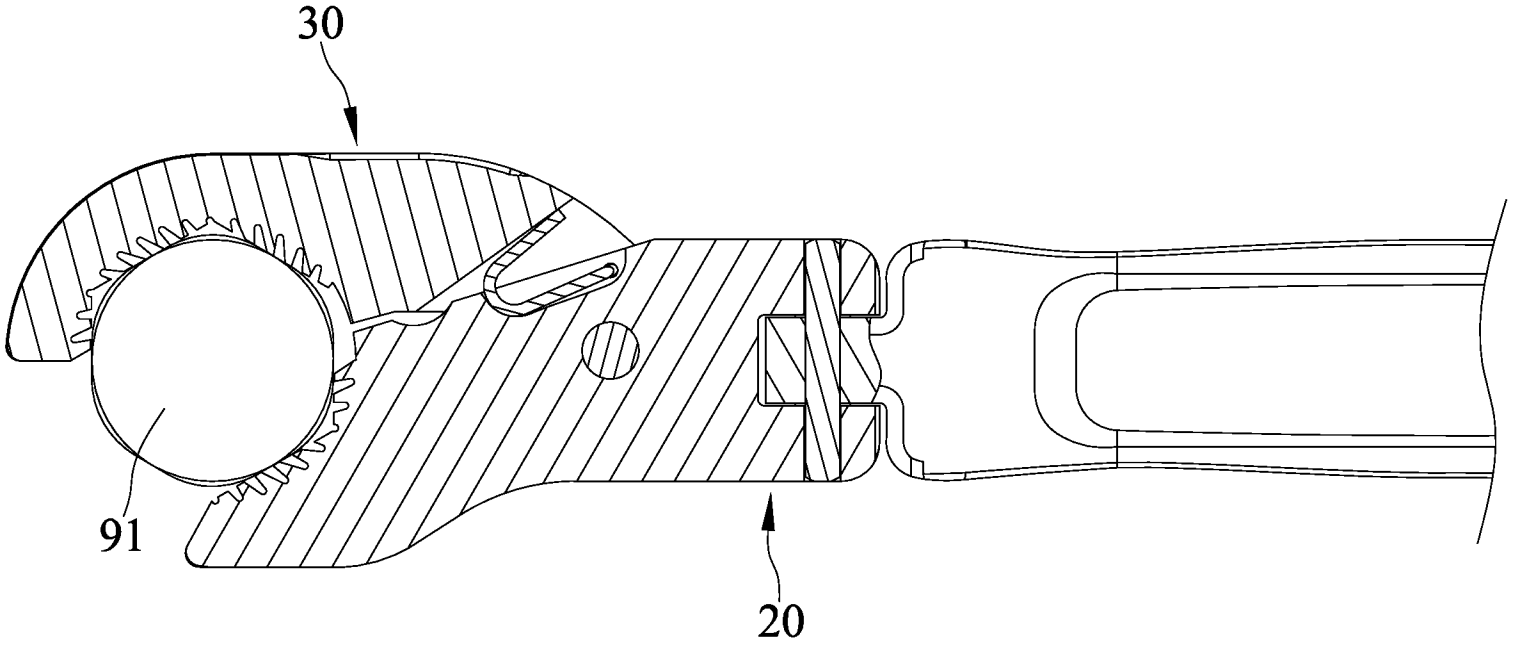
FIG. 7 illustrates the wrench of FIG. 1 grasping an object in which corners are rounded.
Figure 8:
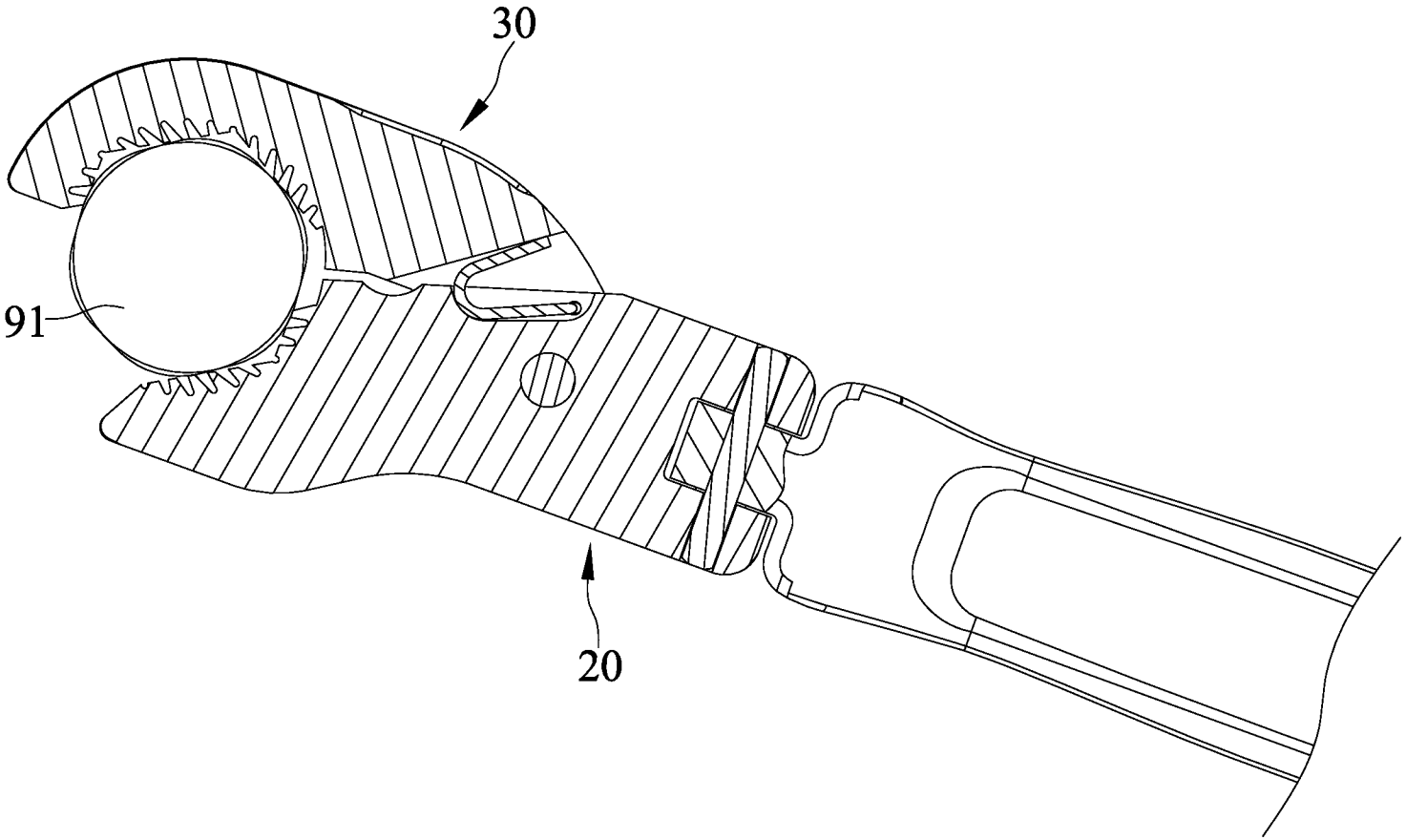
FIG. 8 the wrench of FIG. 1 driving the object to a position different from that of FIG. 7.

FIGS. 1 through 8 show a wrench 10 in accordance with the present invention capable of applying driving force effectively on an object 90. The object 90 is hexagonal and five of six peripheral sides is grasped by the wrench 10. The wrench 10 is also capable of applying driving force on an object 91 to be driven effectively. The object 91 is rounded and indicates that the object 90 is damaged. The wrench 10 includes a driving head segment 20 and a driving head segment 30 and defines a receiving space 21 for receiving the object 90 between the driving head segments 20 and 30.

The driving head segment 20 defines a portion of the receiving space 21 of the wrench 10 and includes a driving side 22 of the wrench 10. The driving side 22 includes a plurality of driving sections 221 for abutting against the object 90 or 91. The plurality of driving sections 221 includes surfaces aligned along an axis P1. Moreover, the driving side 22 includes a plurality of recesses 222 disposed between two adjacent of the plurality of driving sections 221 forms a hook to grasp the object 90 or 91 when the wrench 10 rotates the object 90 or 91. Particularly, the plurality of recesses 222 each extends in a slanting direction to the axis P1. Further, the plurality of recesses 222 each is not symmetrical and has one short side and one long side. The plurality of recesses 222 is disposed alternatively among the plurality of driving sections 221.

The driving head segment 20 further includes a driving side 23 of the wrench 10. The driving side 23 is adjacent to the driving side 22. The driving side 23 includes a plurality of driving sections 231 for abutting against the object 90 or 91. The plurality of driving sections 231 includes surfaces aligned along an axis P2 which extends in a slanting direction to the axis P1. The axes P1 and P2 are intersected with an included angle of 120 degrees. Moreover, the driving side 23 includes a plurality of recesses 232 disposed between two adjacent of the plurality of driving sections 231 so that each driving section 231 forms a hook to grasp the object 90 or 91 when the wrench 10 rotates the object 90 or 91. Particularly, the plurality of recesses 232 each extends in a slanting direction to the axis P2. Further, the plurality of recesses 232 each is not symmetrical and has one short side and one long side. The plurality of recesses 232 is alternatively among the plurality of driving sections 231.

The driving head segment 30 is pivotally connected to the wrench 10. The driving head segment 30 defines a portion of the receiving space 21 of the wrench 10. The drawings show that the driving head segment 30 is pivotally mounted on the driving head segment 20. The driving head segment 30 is urged by a resilient member 24. Particularly, the resilient member 24 has two legs and a turn between the two legs and delimits a space between the two legs. The two legs are respectively retained on the driving head segments 20 and 30.

The driving head segment 30 includes a driving side 31 of the wrench 10. The driving side 31 is adjacent to the driving side 22. The driving side 22 is disposed between the driving sides 22 and 31. The driving side 31 includes a plurality of driving sections 311 for abutting against the object 90 or 91. The plurality of driving sections 311 includes surfaces aligned along an axis P3 which extends in a slanting direction to the axis P2. The driving head segment 30 is pivotal with respect to the driving head segment 20 to a first position in which the axes P2 and P3 are intersected with an included angle of 120 degrees and to a second position in which the axes P2 and P3 are intersected with an included angle greater than 120 degrees. Moreover, the driving side 31 includes a plurality of recesses 312 disposed between two adjacent of the plurality of driving sections 311 so that each driving section 311 forms a hook to grasp the object 90 or 91 when the wrench 10 rotates the object 90 or 91. Particularly, the plurality of recesses 312 each extends in a slanting direction to the axis P3. Further, the plurality of recesses 312 each is not symmetrical and has one short side and one long side. The plurality of recesses 312 is alternatively among the plurality of driving sections 311.

The driving head segment 30 further includes a driving side 32 of the wrench 10. The driving side 32 is adjacent to the driving side 31. The driving side 32 includes a plurality of driving sections 321 for abutting against the object 90 or 91. The plurality of driving sections 321 includes surfaces aligned along an axis P4 which extends in a slanting direction to the axis P3. The axes P3 and P4 are intersected with an included angle of 120 degrees. The axis P4 is substantially parallel to the axis P1. Moreover, the driving side 32 includes a plurality of recesses 322 disposed between two adjacent of the plurality of driving sections 321 so that each driving section 321 forms a hook to grasp the object 90 or 91 when the wrench 10 rotates the object 90 or 91. Particularly, the plurality of recesses 322 each extends in a slanting direction to the axis P4. Further, the plurality of recesses 322 each is not symmetrical and has one short side and one long side. The plurality of recesses 322 is alternatively among the plurality of driving sections 321.

The driving head segment 30 further includes a driving side 33 of the wrench 10. The driving side 33 is adjacent to the driving side 32. The driving side 32 is disposed between the driving sides 31 and 33. The driving side 33 includes a plurality of driving sections 331 for abutting against the object 90 or 91. The plurality of driving sections 331 includes surfaces aligned along an axis P5 which extends in a slanting direction to the axis P4. The axes P4 and P5 are intersected with an included angle of 120 degrees. Moreover, the driving side 33 includes a plurality of recesses 332 disposed between two adjacent of the plurality of driving sections 331 so that each driving section 331 forms a hook to grasp the object 90 or 91 when the wrench 10 rotates the object 90 or 91. Particularly, the plurality of recesses 332 each extends in a slanting direction to the axis P5. Further, the plurality of recesses 332 each is not symmetrical and has one short side and one long side. The plurality of recesses 332 is alternatively among the plurality of driving sections 331.

In view of the foregoing, the driving head segments 20 and 30 allow driving force to be applied on the object 90 or the object 91 effectively so as to grasp the objects 90 and 91. As such, a user can not only use the wrench 10 to drive the object 90, but also the object 91.

The foregoing is merely illustrative of the principles of this invention and various modifications can be made by those skilled in the art without departing from the scope and spirit of the invention.

What is claimed is:

1. A wrench capable of applying driving force on an object to be driven effectively comprising:

a first driving head segment defining a portion of a receiving space of the wrench and including a first driving side of a plurality of driving sides of the wrench, wherein the first driving side includes a plurality of first driving sections for abutting against the object, wherein the plurality of first driving sections includes surfaces which form flat surfaces aligned and extending along a first axis, wherein the first driving side includes a plurality of first recesses disposed alternatively among the plurality of first driving sections such that flat surfaces of adjacent first driving sections are separated, and wherein the plurality of first recesses each extends in a slanting direction to the first axis.

2. The wrench as claimed in claim 1, wherein the plurality of first recesses each is not symmetrical and has one short side and one long side.

3. The wrench as claimed in claim 1, wherein the first driving head segment includes a second driving side of the plurality of driving sides of the wrench, wherein the second driving side is adjacent to the first driving side, wherein the second driving side includes a plurality of second driving sections for abutting against the object, wherein the plurality of second driving sections includes surfaces aligned along a second axis which extends in a slanting direction to the first axis, and wherein the second driving side includes a plurality of second recesses disposed alternatively among the plurality of second driving sections.

4. The wrench as claimed in claim 3, wherein the plurality of second recesses each extends in a slanting direction to the second axis.

5. The wrench as claimed in claim 4, wherein the plurality of second recesses each is not symmetrical and has one short side and one long side.

6. The wrench as claimed in claim 3 further comprising a second driving head segment pivotally connected thereto, wherein the second driving head segment defines a portion of the receiving space of the wrench.

7. The wrench as claimed in claim 6, wherein the second driving head segment is urged by a resilient member.

8. The wrench as claimed in claim 7, wherein the second driving head segment is pivotally mounted on the first driving head segment, wherein the resilient member has two legs and a turn between the two legs and delimits a space between the two legs, and wherein the two legs are respectively retained on the first and the second driving head segments.

9. The wrench as claimed in claim 6, wherein the second driving head segment includes a third driving side of the plurality of driving sides of the wrench, wherein the third driving side is adjacent to the second driving side, wherein the second driving side is disposed between the first and the third driving sides, wherein the third driving side includes a plurality of third driving sections for abutting against the object, wherein the plurality of third driving sections includes surfaces aligned along a third axis which extends in a slanting direction to the second axis, and wherein the third driving side includes a plurality of third recesses disposed alternatively among the plurality of third driving sections.

10. The wrench as claimed in claim 9, wherein the second driving head segment is pivotal with respect to the first driving head segment to a first position in which the second and the third axes are intersected with an included angle of 120 degrees and to a second position in which the second and the third axes are intersected with an included angle greater than 120 degrees.

11. The wrench as claimed in claim 10, wherein the plurality of third recesses each extends in a slanting direction to the third axis.

12. The wrench as claimed in claim 11, wherein the plurality of third recesses each is not symmetrical and has one short side and one long side.

13. The wrench as claimed in claim 9, wherein the second driving head segment includes a fourth driving side of the plurality of driving sides of the wrench, wherein the fourth driving side is adjacent to the third driving side, wherein the fourth driving side includes a plurality of fourth driving sections for abutting against the object, wherein the plurality of fourth driving sections includes surfaces aligned along a fourth axis which extends in a slanting direction to the third axis, and wherein the fourth driving side includes a plurality of fourth recesses disposed alternatively among the plurality of fourth driving sections.

14. The wrench as claimed in claim 13, wherein the plurality of fourth recesses each extends in a slanting direction to the fourth axis.

15. The wrench as claimed in claim 14, wherein the plurality of fourth recesses each is not symmetrical and has one short side and one long side.

16. The wrench as claimed in claim 13, wherein the second driving head segment includes a fifth driving side of the plurality of driving sides of the wrench, wherein the fifth driving side is adjacent to the fourth driving side, wherein the fourth driving side is disposed between the third and the fifth driving sides, wherein the fifth driving side includes a plurality of fifth driving sections for abutting against the object, wherein the plurality of fifth driving sections includes surfaces aligned along a fifth axis which extends in a slanting direction to the fourth axis, and wherein the fifth driving side includes a plurality of fifth recesses disposed alternatively among the plurality of fifth driving sections.

17. The wrench as claimed in claim 16, wherein the plurality of fifth recesses each extends in a slanting direction to the third axis, respectively.

18. The wrench as claimed in claim 17, wherein the plurality of fifth recesses each is not symmetrical and has one short side and one long side.

19. The wrench as claimed in claim 16, wherein the first and the second axes are intersected with an included angle of 120 degrees, wherein the third and the fourth axes are intersected with an included angle of 120 degrees, and wherein the fourth and the fifth axes are intersected with an included angle of 120 degrees.

* * * * *